US012004618B2

(12) United States Patent
Yuan et al.

(10) Patent No.: US 12,004,618 B2
(45) Date of Patent: Jun. 11, 2024

(54) CASE WITH EXTRACTABLE/RETRACTABLE CHARGING PORT

(71) Applicant: TARGUS INTERNATIONAL LLC, Anaheim, CA (US)

(72) Inventors: Jonny Yuan, Anaheim, CA (US); Alex Robert Cabunoc, Anaheim, CA (US)

(73) Assignee: Targus International LLC, Anaheim, CA (US)

( * ) Notice: Subject to any disclaimer, the term of this patent is extended or adjusted under 35 U.S.C. 154(b) by 3 days.

(21) Appl. No.: 17/455,349

(22) Filed: Nov. 17, 2021

(65) Prior Publication Data

US 2022/0151358 A1 May 19, 2022

Related U.S. Application Data

(60) Provisional application No. 63/114,916, filed on Nov. 17, 2020.

(51) Int. Cl.
*A45C 13/02* (2006.01)
*A45C 3/00* (2006.01)
(Continued)

(52) U.S. Cl.
CPC ..... *A45C 13/02* (2013.01); *A45C 11/00* (2013.01); *A45C 13/001* (2013.01);
(Continued)

(58) Field of Classification Search
CPC ..... A45C 13/02; A45C 11/00; A45C 13/001; A45C 13/002; A45C 2003/008;
(Continued)

(56) References Cited

U.S. PATENT DOCUMENTS 4,924,557 A * 5/1990 Heckerman ..... F41C 33/002 24/17 AP
7,855,529 B2 12/2010 Liu
(Continued)

FOREIGN PATENT DOCUMENTS

CN 204317802 U * 5/2015 ..... H02J 7/0042
CN 206252064 U * 6/2017
(Continued)

OTHER PUBLICATIONS

KR 20100000015 U: Google machine generated English translation. (Year: 2010).*
(Continued)

*Primary Examiner* — Don M Anderson
*Assistant Examiner* — Justin Caudill
(74) *Attorney, Agent, or Firm* — Stoel Rives LLP

(57) ABSTRACT

A case including a support member is disclosed. The support member includes a port well and a collar for receiving an internal charging port of the case. An elastic tether is coupled to the support member and the case and configured to facilitate extraction of the support member from an aperture of the case for coupling of the internal charging port to an external charging port. The elastic tether also facilitates retraction of the support member and internal charging port into the aperture. The support member also includes a tab for grasping by a user.

20 Claims, 5 Drawing Sheets

(51) Int. Cl.
*A45C 11/00* (2006.01)
*A45C 13/00* (2006.01)

(52) U.S. Cl.
CPC ..... *A45C 13/002* (2013.01); *A45C 2003/008* (2013.01); *A45C 2011/001* (2013.01); *A45C 2011/002* (2013.01); *A45C 2013/025* (2013.01)

(58) Field of Classification Search
CPC ..... A45C 2011/001; A45C 2011/002; A45C 2013/025
See application file for complete search history.

(56) References Cited

U.S. PATENT DOCUMENTS

| | | | | |
|---|---|---|---|---|
| D716,313 | S * | 10/2014 | Park | D14/484.1 |
| 8,907,752 | B2 | 12/2014 | Wodrich et al. | |
| 8,917,506 | B2 | 12/2014 | Diebel et al. | |
| 8,995,127 | B2 | 3/2015 | Richardson | |
| 9,071,009 | B2 * | 6/2015 | Ardisana | H01R 13/5812 |
| 9,288,295 | B2 | 3/2016 | Ivanovski et al. | |
| 9,537,523 | B2 | 1/2017 | Chen et al. | |
| 9,609,093 | B2 | 3/2017 | Wong | |
| 9,671,835 | B2 | 3/2017 | Filipovic et al. | |
| 9,654,605 | B2 | 5/2017 | Goldfain | |
| 9,673,565 | B1 * | 6/2017 | Lowas, III | A45F 5/00 |
| 9,678,537 | B2 | 6/2017 | Kupferstein et al. | |
| 9,729,187 | B1 | 8/2017 | Adelmann | |
| 9,826,652 | B2 | 11/2017 | Adelmann | |
| 9,854,897 | B1 * | 1/2018 | Pelkey, Jr. | H01M 50/267 |
| 10,039,358 | B2 * | 8/2018 | Hanson | A45C 11/24 |
| 10,068,529 | B2 | 9/2018 | Hekmatshoartabari et al. | |
| 10,164,439 | B2 | 12/2018 | Jeong et al. | |
| 10,211,871 | B2 | 2/2019 | Noori et al. | |
| 10,236,927 | B2 | 3/2019 | Thiel et al. | |
| 10,236,940 | B2 | 3/2019 | Kim | |
| 10,340,970 | B2 | 7/2019 | Richardson | |
| 10,547,036 | B1 * | 1/2020 | Ashley | H02J 7/342 |
| 10,551,890 | B2 | 2/2020 | Wodrich | |
| 2007/0052388 | A1 | 3/2007 | Wilson et al. | |
| 2009/0224722 | A1 * | 9/2009 | Causey | A45C 15/00 320/101 |
| 2012/0220162 | A1 * | 8/2012 | Zhou | H01R 13/72 439/501 |
| 2012/0262117 | A1 * | 10/2012 | Ferber | H02J 7/0048 320/111 |
| 2013/0214931 | A1 * | 8/2013 | Chia | A45C 15/00 320/108 |
| 2014/0061273 | A1 * | 3/2014 | Bullivant | A45F 3/04 224/576 |
| 2014/0263869 | A1 * | 9/2014 | Clark-Mantle | H01R 13/72 248/65 |
| 2015/0101958 | A1 * | 4/2015 | Cross | A45C 11/38 206/703 |
| 2015/0270728 | A1 * | 9/2015 | Williams | H02J 7/0044 320/111 |
| 2015/0366333 | A1 * | 12/2015 | Zhijian | A45C 15/00 224/576 |
| 2017/0220067 | A1 | 8/2017 | Rane et al. | |
| 2017/0324200 | A1 * | 11/2017 | Gorin | H01R 25/006 |
| 2018/0152037 | A1 * | 5/2018 | Yu | H02J 7/342 |
| 2018/0303213 | A1 * | 10/2018 | Pusey | A45C 15/02 |
| 2019/0212782 | A1 | 7/2019 | Okada et al. | |
| 2020/0000207 | A1 * | 1/2020 | Liu | H02J 7/342 |
| 2020/0021325 | A1 | 1/2020 | Kim et al. | |
| 2020/0144837 | A1 | 5/2020 | To et al. | |
| 2020/0144858 | A1 | 5/2020 | Su | |
| 2020/0253349 | A1 * | 8/2020 | Quartarone, III | H02J 7/0045 |
| 2020/0287404 | A1 * | 9/2020 | Zhijian | H02J 7/0042 |

FOREIGN PATENT DOCUMENTS

| | | | | |
|---|---|---|---|---|
| DE | 102008029815 | A1 * | 12/2009 | A45C 11/00 |
| JP | 2011061915 | A | 3/2011 | |
| KR | 2020100000015 | U | 1/2010 | |
| KR | 1020140132850 | A | 11/2014 | |
| WO | WO-2019017946 | A1 * | 1/2019 | A45F 3/02 |
| WO | 2019039689 | A1 | 2/2019 | |
| WO | 2019182813 | A1 | 9/2019 | |
| WO | 2019238238 | A1 | 12/2019 | |
| WO | 2019238290 | A1 | 12/2019 | |

OTHER PUBLICATIONS

PCT/US2021/072465, International Search Report and Written Opinion, dated Mar. 8, 2022, 10 pages.

* cited by examiner

CASE WITH EXTRACTABLE/RETRACTABLE CHARGING PORT

RELATED APPLICATIONS

This application claims priority to U.S. Provisional Application No. 63/114,916, filed on Nov. 17, 2020 and titled "Case With Extractable/Retractable Charging Port," which is hereby incorporated by reference in its entirety.

TECHNICAL FIELD

This disclosure generally relates to travel and carry bags with built-in charging apparatuses.

BRIEF DESCRIPTION OF THE DRAWINGS

Non-limiting and non-exhaustive embodiments of the disclosure are described, including various embodiments of the disclosure with reference to the figures, in which.

DETAILED DESCRIPTION

Travel bags and other types of luggage may include charging equipment to allow travelers to charge electronic devices such as mobile phones, tablets, laptops and the like. A travel bag may include a battery in electrical communication with a cable and port to allow convenient access for charging. A travel bag may also include equipment to charge the battery based on ambient motion or movement of wheels attached to the travel bag. A travel bag may also include one or more solar panels integrated with the travel bag to charge the battery. Thus, motion or the solar panels in conjunction with the recharging equipment generate the electric charge to charge the battery. The travel bag may also include a charging cable in electric communication with an AC/DC converter and the battery. The charging cable may couple to an AC outlet to receive power to charge the battery. Thus equipped, the travel bag may avow travelers to conveniently charge electronic devices while waking or waiting.

Embodiments may be understood by reference to the drawings, wherein like parts are designated by like numerals throughout. It will be readily understood by one of ordinary skill in the art having the benefit of this disclosure that the components of the embodiments, as generally described and illustrated in the figures herein, could be arranged and designed in a wide variety of different configurations. Thus, the following more detailed description of various embodiments, as represented in the figures, is not intended to limit the scope of the disclosure, but is merely representative of various embodiments. While the various aspects of the embodiments are presented in drawings, the drawings are not necessarily drawn to scale unless specifically indicated.

Figure 1:
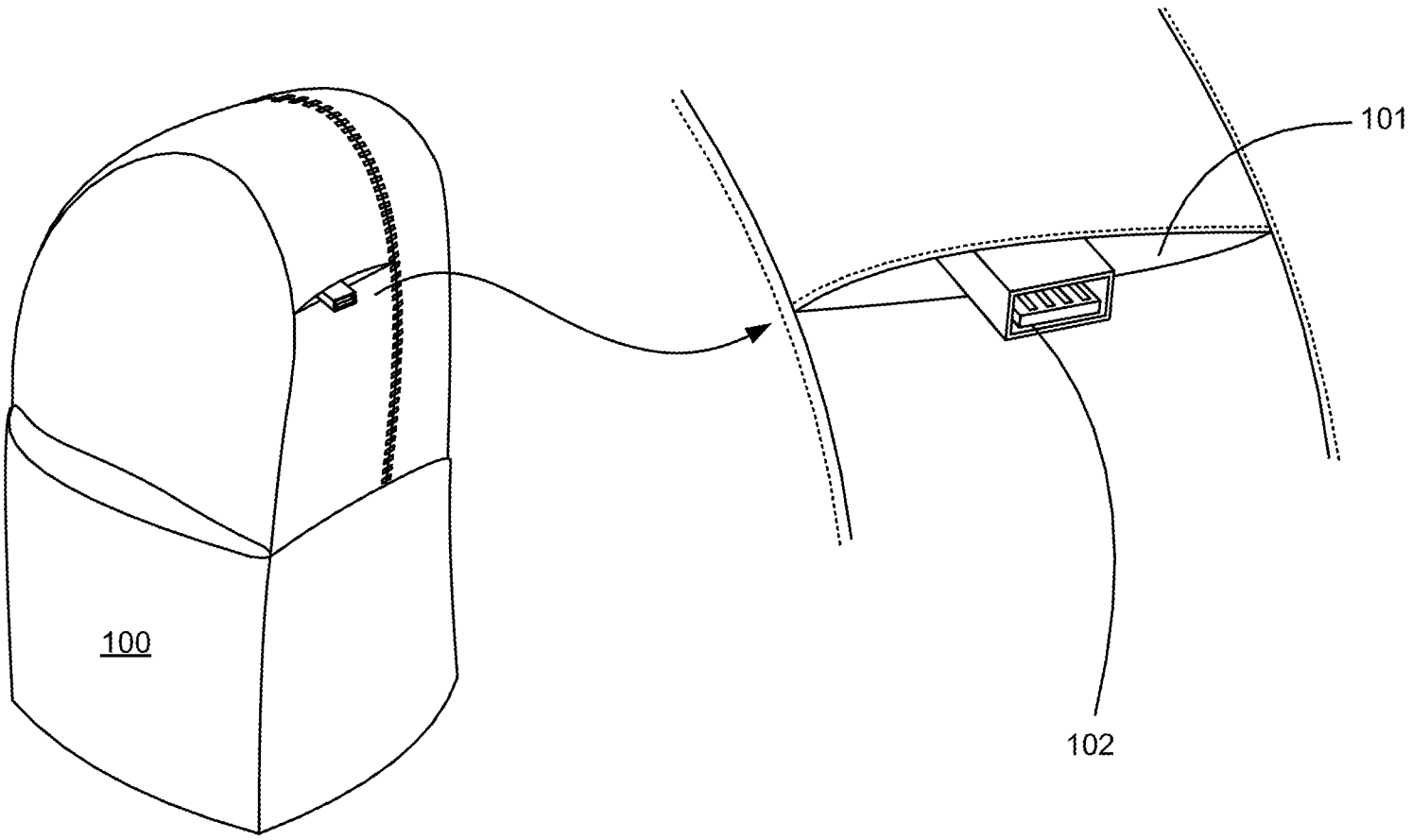
FIG. 1 illustrates an embodiment of a travel bag with a port.

FIG. 1 illustrates an embodiment of a travel bag with a port. FIGS. 2-5 illustrate an embodiment of a support member of the travel bag. In certain views each device may be coupled to, or shown with, additional components not included in every view. Further, in some views only selected components are illustrated, to provide detail into the relationship of the components. Some components may be shown in multiple views, but not discussed in connection with every view. Disclosure provided in connection with any figure is relevant and applicable to disclosure provided in connection with any other figure or embodiment.

FIG. 1 illustrates a travel bag 100 that may include a battery (not shown), and a battery cable (not shown) to charge the battery. As can be appreciated, the travel bag 100 may take any number of shapes, forms, and designs. Thus, the travel bag 100 may be a backpack, bi-fold case, roller luggage, briefcase, and the like. The travel bag 100 often accommodates a laptop, tablet, or one or more other portable electronic devices. The travel bag 100 may include charging equipment to recharge the battery. The travel bag 100 includes an internal port 102 to interface with an exterior port to charge an electronic device. The internal port 102 may be accessible through an aperture or opening 101, such as a pocket, fold, slit, or the like, disposed in the travel bag 100. The internal port 102 may be embodied as any one of various ports known in the art including a commonly used USB-C port or ports of another USB type.

Figure 2:
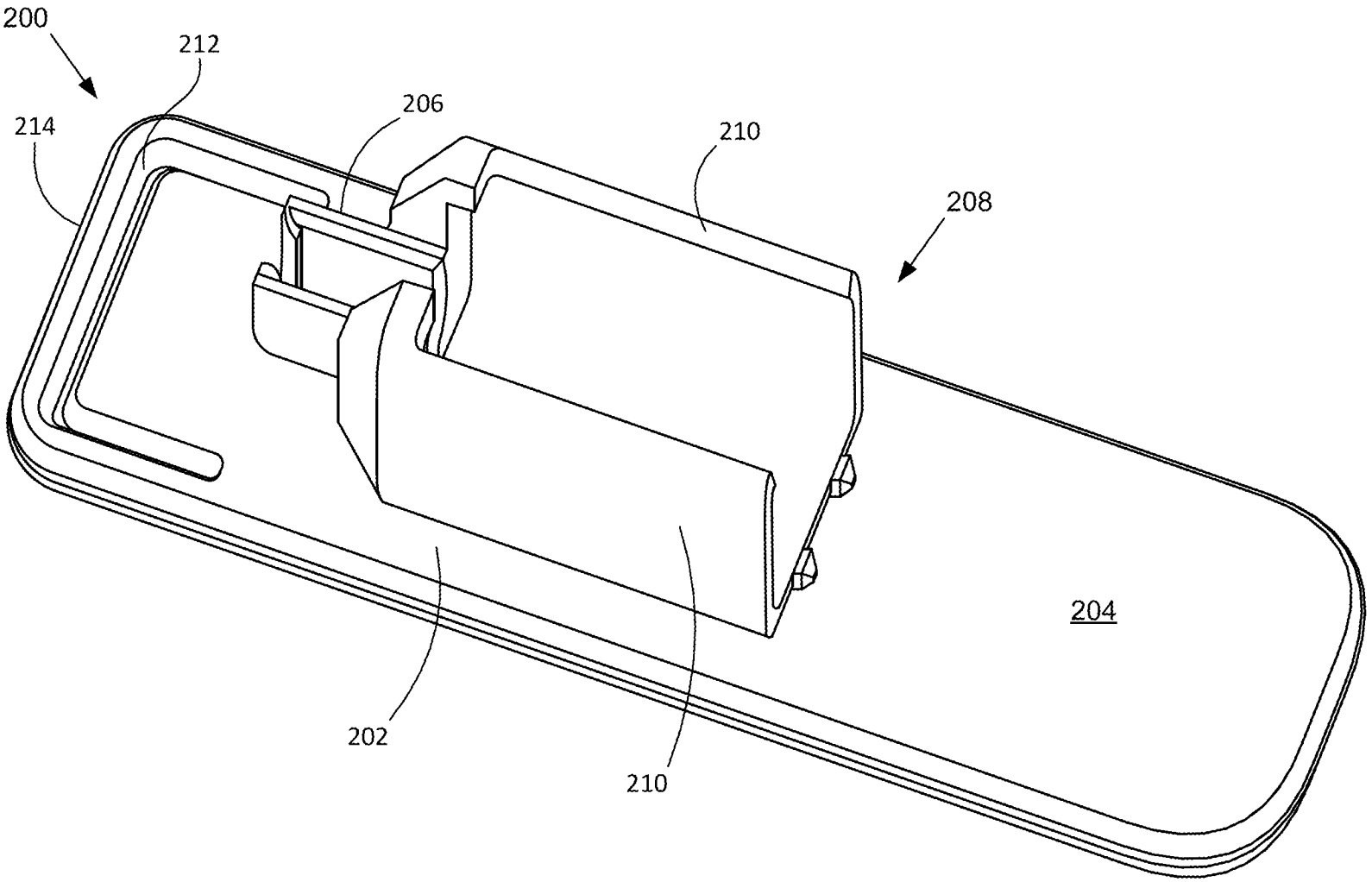
FIG. 2 illustrates an embodiment of a support member.

FIG. 2 illustrates a support member 200 to receive the internal port 102 and an attached cable. The support member 200 includes a planar support 202 that may, as illustrated, be approximately rectangular with rounded corners. The planar support 202 may alternatively be embodied in an oval shape or any various suitable shapes. The planar support 202 may include a tab 204 that facilitates manual gripping of the planar support 202. Thus, a user may grip the tab 204 and extract the planar support 202 from the travel bag 100. The support member 200 includes a cable collar 206 that receives and at least partially extends around a cable. The cable collar 206 is in communication with a port well 208 that receives and partially extends around a port. As illustrated, the cable collar 206 and port well 208 are integrally secured to the planar support 202. The cable collar 206, port well 208, and planar support 202 may all be integrally formed of the same material such as any suitable plastic material such as injected molded thermoplastic polyurethane.

The port well 208 may include sidewalls 210 that extend from the planar support 202. The sidewalls 210 are of sufficient length to secure the received port. The sidewalls 210 do not interfere with the port mating with an external port.

Figure 3:
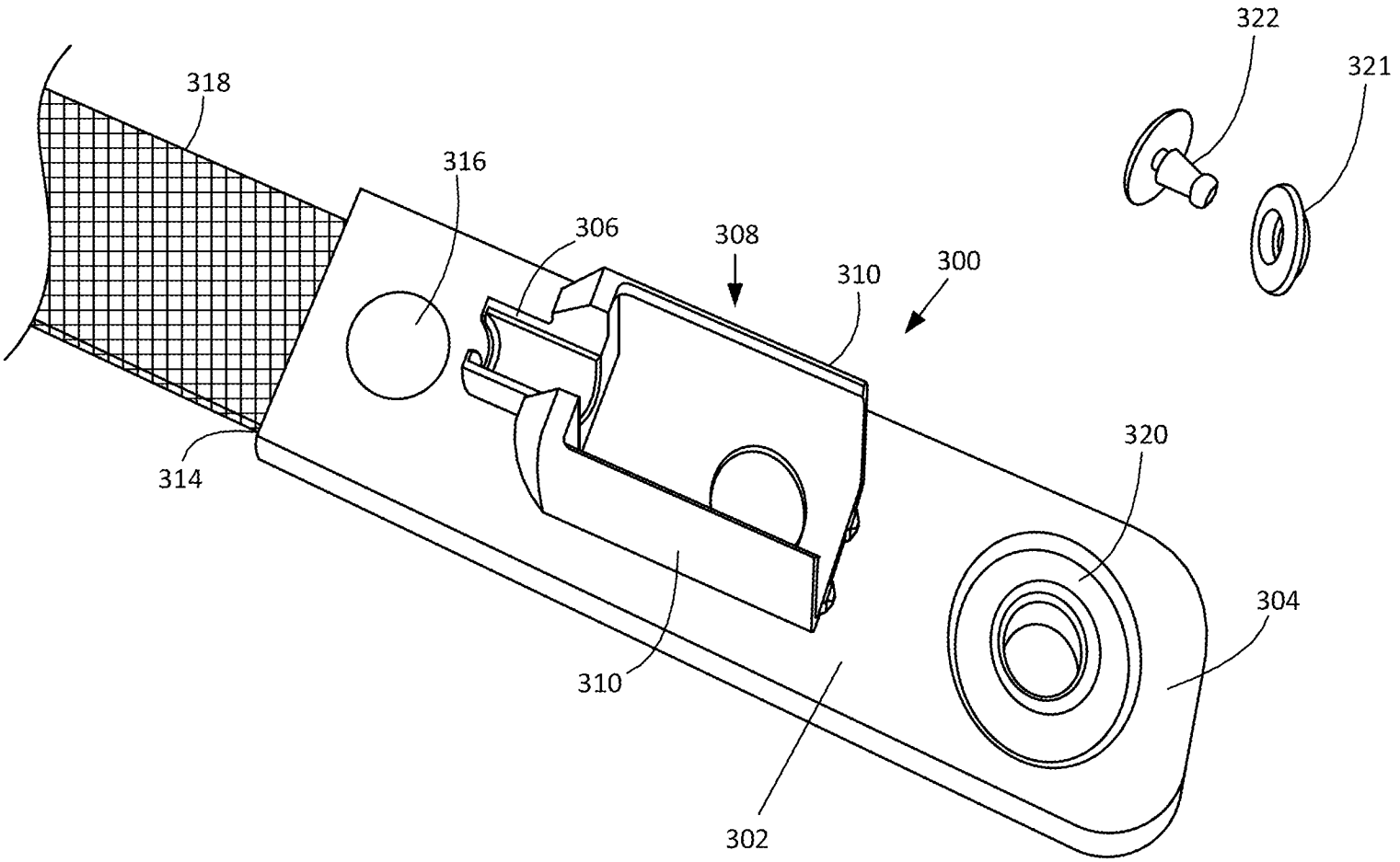
FIG. 3 illustrates an embodiment of a support member secured to an elastic tether.
Figure 4:
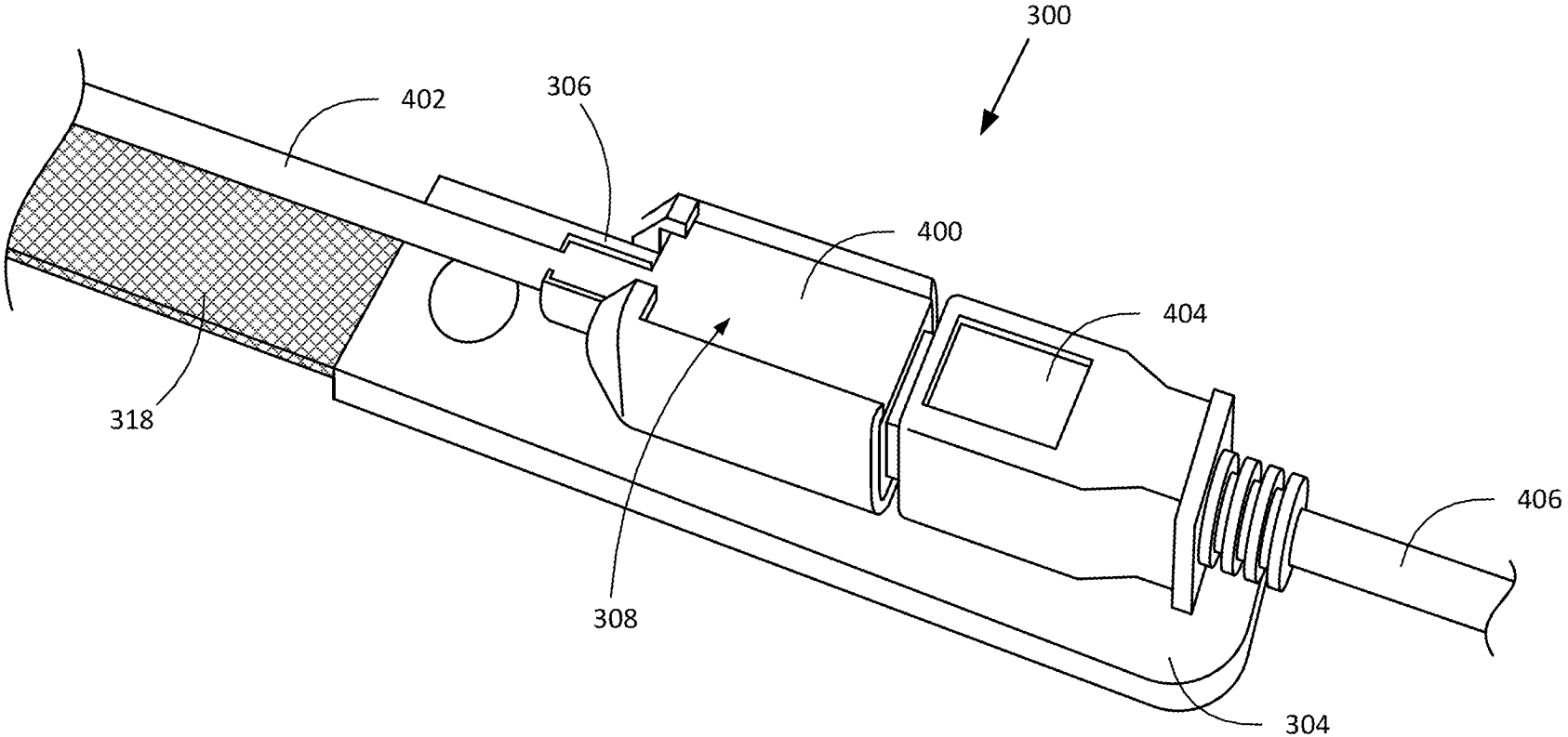
FIG. 4 illustrates the support member of FIG. 3 with a cable and port secured within.

The support member 200 may further include a debossed track 212 to facilitate attachment, such as by sewing, to an elastic tether, as shown in FIGS. 3 and 4. The track 212 may extend along at least a portion of a proximal end 214 of the support member 200.

FIG. 3 illustrates an alternative embodiment of a support member 300. The support member 300 may include a planar support 302, tab 304, cable collar 306, port well 308, sidewalls 310, and proximal end 314 as in the embodiment of FIG. 2. The support member 300 may include a rivet 316 attached to the planar support 302, adjacent to the proximal end 314, and further attached to an elastic tether 318. The elastic tether 318 enables extraction and retraction of the support member 300 from and to the travel bag 100. The elastic tether 318 may include a webbing material, and the elastic tether 318 is of a length to allow for suitable tension for extraction and retention. The elastic tether 318 is secured at another end to an interior of the travel bag 100. The elastic tether 318 and support member 300 may extend and retract through the aperture 101 in the travel bag 100 as shown in FIG. 1.

The support member 300 may further include a tab fastener 320 disposed on the tab 304. The tab fastener 320 is configured to attach to the travel bag 100. In the illustrated embodiment, the tab fastener 320 is embodied as a fisheye snap button 321. The snap button 321 receives a stud 322 attached to the travel bag 100 to enable removable attachment of the tab fastener 320 to the travel bag 100. To avoid difficulty in locating the support member 300, and a port within, the support member 300 may be removably attached at the same location on the travel bag 100. The support member 300 may partially extend from the aperture 101 in the travel bag 100 in the retracted position, as shown in FIG. 1. In the extracted position, a user extends the support member 300 from the travel bag 100 and fully exposes a port nested in the port well 308.

FIG. 4 illustrates the support member 300 of FIG. 3 with an internal port 400 nested within the port well 308. A cable 402, coupled to the internal port 400, is nested within the cable collar 306. An external port 404 rests on the tab 304 and mates with the internal port 400. An external cable 406 is in electrical communication with the external port 404 and an electronic device to be charged.

Figure 5:
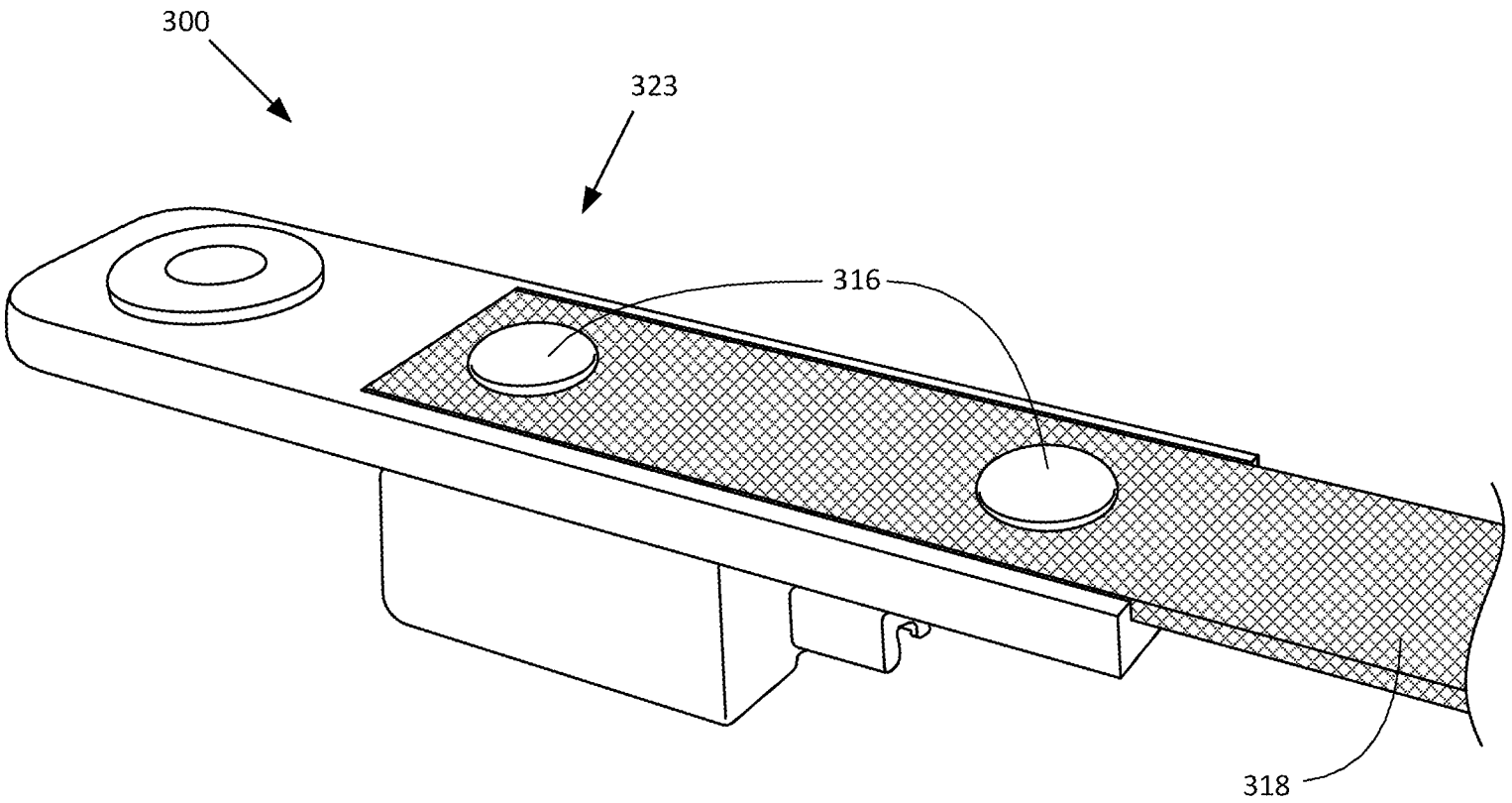
FIG. 5 illustrates the support member of FIG. 3.

FIG. 5 illustrates the support member 300 of FIGS. 3 and 4. The support member 300 is "flipped over" from the position shown in FIGS. 3 and 4. As shown, the elastic tether 318 extends along the bottom side 323 of the support member 300. The elastic tether 318 is secured to the support member 300 by first and second rivets 316. As can be appreciated, any number of rivets may be used to secure the elastic tether 318. The elastic tether 318 may also be secured to the support member 300 by stitches, staples, adhesives, and the like. The rivets 316 may be configured to allow removable attachment of the support member 300 to the elastic tether 318.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified. For example, a method of charging an electronic device may include one or more of the following steps: coupling an internal charging port of a case with a support member; grasping the support member with user's fingers; extracting the internal charging port and the support member from an aperture of the case; and coupling an external charging port to the internal charging port. Other steps are also contemplated.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

In the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment.

The phrases "coupled to" and "in communication with" refer to any form of interaction between two or more entities, including mechanical, electrical, magnetic, electromagnetic, fluid, and thermal interaction. Two components may be coupled to or in communication with each other even though they are not in direct contact with each other. For example, two components may be coupled to or in communication with each other through an intermediate component.

The terms "a" and "an" can be described as one, but not limited to one. For example, although the disclosure may recite a housing having "a stopper," the disclosure also contemplates that the housing can have two or more stoppers.

Recitation in the claims of the term "first" with respect to a feature or element does not necessarily imply the existence of a second or additional such feature or element.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

The invention claimed is:

1. A case, comprising:

a support member including, a planar support including a proximal end attached to an end of an elastic tether, a port well disposed on the planar support and configured to receive an internal port of the case, sidewalls of the port well to secure the internal port without interfering with attachment and detachment of an external port to and from the internal port while the internal port is secured in the port well, the planar support extending beyond the sidewalls of the port well, and a cable collar disposed on the planar support and configured to receive a cable coupled to the internal port; and the elastic tether coupled to a case interior.

2. The case of claim 1, wherein the planar support comprises a rectangular shape having rounded corners.

3. The case of claim 1, wherein the cable collar is in communication with the port well.

4. The case of claim 1, wherein the planar support comprises a debossed track configured to facilitate coupling of the elastic tether to the support member.

5. The case of claim 1, wherein the planar support comprises a rivet configured to facilitate coupling of the elastic tether to the support member.

6. The case of claim 1, wherein the planar support further includes a tab configured to be gripped by a user to remove the support member from the case.

7. The case of claim 1, wherein the elastic tether is configured to allow extension of the support member from the case and retention of the support member within the case.

8. The case of claim 1, further comprising an aperture configured to provide access to the support member.

9. The case of claim 8, wherein the aperture comprises one or more of a pocket, fold, and slit.

10. The case of claim 1, wherein the internal port is a USB-C port.

11. A support member, comprising:

a planar support including a proximal end attached to an end of a tether, a port well disposed on the planar support and configured to receive a port, sidewalls defining the port well to secure the port without interfering with attachment of an external port to and from the port while the port is secured in the port well, the planar support extending beyond the sidewalls of the port well, and a cable collar disposed on the planar support and configured to receive a cable coupled to the port.

12. The support member of claim 11, wherein the planar support comprises a rectangular shape having rounded corners.

13. The support member of claim 11, wherein the sidewalls extend from the planar support.

14. The support member of claim 11, wherein the cable collar is in communication with the port well.

15. The support member of claim 11, wherein the planar support further includes a tab configured to be gripped by a user.

16. The support member of claim 11, comprising a thermoplastic polyurethane material.

17. A method of charging an electronic device, comprising:

securing an internal charging port of a case within a port well of a support member coupled to an end of a tether;

grasping the support member with user's fingers;

extracting the internal charging port and the support member from an aperture of the case; and coupling and decoupling an external charging port to and from the internal charging port while the internal charging port is secured in the port well without sidewalls of the port well interfering with the coupling and decoupling of the external charging port to and from the internal charging port.

18. The method of claim 17, wherein the support member comprises:

a planar support, the port well disposed on the planar support, and a cable collar disposed on the planar support and configured to receive a cable coupled to the internal charging port.

19. The method of claim 17, wherein the tether is an elastic tether.

20. The method of claim 19, further comprising retracting the internal charging port and the support member into the aperture by the elastic tether.

* * * * *